US007587163B2

(12) United States Patent
Parks et al.

(10) Patent No.: US 7,587,163 B2
(45) Date of Patent: Sep. 8, 2009

(54) CLEANING BLADE EDGE STIFFENER TO IMPROVE BLADE TUCKING ROBUSTNESS

(75) Inventors: Bruce J. Parks, Bloomfield, NY (US); Michael Q. Lu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 342 days.

(21) Appl. No.: 11/726,256

(22) Filed: Mar. 21, 2007

(65) Prior Publication Data

US 2008/0232874 A1 Sep. 25, 2008

(51) Int. Cl.
*G03G 21/00* (2006.01)

(52) U.S. Cl. ..... 399/350

(58) Field of Classification Search ..... 399/350, 399/351

See application file for complete search history.

(56) References Cited

U.S. PATENT DOCUMENTS

2004/0265024 A1 * 12/2004 Naruse et al. ..... 399/350

* cited by examiner

*Primary Examiner*—Hoang Ngo
(74) *Attorney, Agent, or Firm*—James J. Ralabate

(57) ABSTRACT

This is a cleaning blade useful in an electrophotographic marking system. Under certain conditions, cleaning blades will tuck when the blade continuously contacts a photoconductive surface of this marking system. This tucking causes abrading and damage to the moving photoconductive surface. To prevent or minimize tucking, a blade stiffener is used in this invention in either an add-on or as a part of the originally-manufactured elastomeric blade.

5 Claims, 4 Drawing Sheets

CLEANING BLADE EDGE STIFFENER TO IMPROVE BLADE TUCKING ROBUSTNESS

The present embodiments relate to an electrophotographic marking system and, more specifically, to a cleaning blade useful in said system.

BACKGROUND

In marking systems such as Xerography or other electrostatographic processes, a uniform electrostatic charge is placed upon a photoreceptor surface. The charged surface is then exposed to a light image of an original to selectively dissipate the charge to form a latent electrostatic image of the original. The latent image is developed by depositing finely divided and charged particles of toner upon the photoreceptor surface. The toner may be in dry powder form or suspended in a liquid carrier. The charged toner being electrostatically attached to the latent electrostatic image areas creates a visible replica of the original. The developed image is then usually transferred from the photoreceptor surface to a final support material, such as paper, and the toner image is fixed thereto to form a permanent record corresponding to the original.

In these electrostatic marking systems, a photoreceptor surface is generally arranged to move in an endless path through the various processing stations of the Xerographic process. Sometimes the photoreceptor is in the form of an endless belt and in other systems in the form of a drum. Since the photoreceptor surface is reusable when the toner image is transferred to a final support material such as paper, the surface of the photoreceptor is cleaned and prepared to be used once again in the copying process. In this endless path, several Xerographic related stations are traversed by the photoconductive belt or drum.

In these type systems, in one embodiment, after the transfer station, a photoconductor cleaning station is next. This cleaning station may comprise a first cleaning brush, a second cleaning brush and with the brushes is positioned a cleaning blade or doctor blade which is used to remove residual debris from the belt. A film or debris is generally caused by the toner being impacted onto the belt by the cleaning brushes. When the lubrication of this blade is below a necessary level, the blade can abrade or damage the belt. Toner is the primary lubricant used for the blade, however, a problem can exist with a degradation of the cleaning efficiency of the cleaning brushes or the blade. Without proper lubrication or other problems, this cleaning blade can tuck and seriously abrade the belt. Elastomeric cleaning blades, especially in doctor mode, run the risk of blade tucking. Blade tucking always starts at one of the working corners of the blade due to reduced blade stiffness at the corners and can work itself along the entire edge until the entire blade is flipped into a wiper mode-like position. Blade optimization for cleaning, filming, abrasion and other performance parameters is highly constrained by the blade tuck operating space. In other words, to ensure the blade is configured in such a way as to ensure some degree of tucking robustness, compromises must be made in the overall performance of the blade system.

The first brush above mentioned as used in prior art systems is responsible for nearly all of the filming on the photoconductive (PC) belt. This brush is positively charged to attract a negative charged toner and remove most of it from the PC belt. Adjacent to the first brush is a vacuum which vacuums the toner from the brush for later disposal. Any toner that may have acquired a positive charge will pass by the first positively charged brush and will be picked up by the second brush which is negatively charged. The vacuum is also adjacent to the second brush and should vacuum off the brush any residual positively charged toner. Then, as above noted, the doctor or cleaning blade scrapes off the belt any remaining toner debris or film layer. Again, after the action of the two prior cleaning brushes, there is generally not sufficient toner lubrication for an effective action by this cleaning blade. The cleaning blade will remove the film layer comprised of toner additives that is caused by the impact of the first brush against the toner and PC belt. The serious problem that has been encountered in this type of prior art arrangement is, as noted, that the cleaning blade does not get enough toner-provided lubrication and can easily tuck and scratch or damage the belt causing a relatively high replacement rate for both the belt and the cleaning blade. In addition, copy quality begins to deteriorate as the cleaning blade becomes tucked and is abraded and damaged or as the film and toner is less effectively removed from the PC belt by this blade. Another problem that results from blade tuck is increased drag imparted by the blade to the PC surface which can cause motion quality problems and degraded image quality.

Many of the prior art low volume electrophotographic printers and some high speed marking apparatus use elastic doctor blades to remove residual toner from drum or belt photoreceptors. Improvements in the reliability of such blades are desired to minimize/reduce wear-induced defects and extend the overall life of the cleaning blade. Unloaded polyurethane and other elastomeric materials are typically useful in cleaning blade materials. Improvements are required to extend the useful life of such blades and to make the doctor blades or cleaning blades more efficient.

SUMMARY OF THE INVENTION

The present embodiments propose in one configuration in a Xerographic cleaning station to use a corner stiffener at the ends of the elastomeric cleaning blade to prevent blade tuck at the ends of the blade. Blade tucking, as earlier noted, is a common failure mode for blade cleaners due to the low toner lubrication near the blade edge and lack of structural support of the blade edge. A variety of complicated methods could be used to reduce this problem ranging from adding extra lubrication in that region to modifying the design of the blade or blade holder. This invention in one configuration proposes to add a small stiffener to the blade ends or to the entire bottom length of the blade. By adding structural rigidity to the blade, tucking is prevented. The stiffener would be made of a rigid material. Plated steel was used for our testing but any number of suitable materials could be used (metals, plastics, etc.). The stiffener in one embodiment would be on the blade face opposite to the "working edge" (the face that contacts the photoreceptor). It is suggested that the stiffeners could be adhesively attached as a final step in the blade assembly process. Alternatively, in a second embodiment, if a molded blade was used, the stiffeners could be molded integral with the blade. When the stiffeners in this second molded embodiment are used, the stiffener could be on the face that contacts the PC (the side of the working edge) or on the opposite face or side.

While the embodiments of this invention will be described herein with reference to a cleaning blade in contact with a PC surface, the stiffened blade of this invention can be used in any portion of a Xerographic system where a doctor blade contacts a surface to be cleaned. A "doctor blade" is defined, for purposes of this invention, as a blade where the blade extension is pointing in a direction opposite to the travel of the surface being cleaned. Obviously, uses of the present invention in non-xerographic systems will occur to those skilled in the art.

In the embodiment where the stiffener is added to an existing blade, obviously, the stiffener would be on the face opposite to the face that contacts the photoreceptor (PC). The drawings and their description will further define these embodiments.

The stiffeners can be located across the entire length of the cleaning blade or can be located only in the corners of the blade depending on the specific requirements and desired conditions.

The use of a corner stiffener or a stiffener across the entire blade length have been shown to be very effective in preventing blade tuck. The stiffener consists of a plate that is adhered to the bottom cleaner blade surface on a side opposite of the working edge. The width, length and thickness and material choice of the plate may need to be optimized for the application. The function of the stiffener is to increase the rigidity of the blade corners or entire bottom edge without significantly changing the working angle or normal force at the working edge. This requires the plate to have a small width dimension. The plate should be adhered as close as possible to the corner edge though micron tolerances are not required to achieve the desired function.

The stiffener material choice is not considered critical as long as it reduces blade tuck and it is inert with respect to the materials that will come in contact with it (e.g. toner, additives, fuser oil, paper dust, etc.). If a metallic material is used as a stiffener, it may be required to be electrically grounded. The key design requirement is to achieve sufficient stiffness in the length dimension to prevent tucks. Therefore, material modulus will be important for a given set of physical dimensions. The length of the stiffener is also important as in one embodiment it should be at least as long as the blade extension length and can be as long as the entire length of the blade. In another embodiment, the stiffener can be located only in the corners of the bottom portion of the blade.

Prototypes of the cleaning blade with a stiffener have been built and tested. While exact proportions of blade dimensions to stiffener is difficult to completely describe because of the large variety of blades and their dimensions available or to be used, modeling or various empirical tests can be conducted to easily ascertain the type and size of stiffener to be used in a particular application. Therefore, while a specific numerical ratio or formula is difficult to define because of varied size cleaner blades used, tests were conducted at various stress conditions (see below) to prove reduction of tuck effectiveness for the stiffener.

In one test, the following conditions were present and prototypes have been fabricated and tested under the following stress tuck conditions:

Test Stress Conditions:

1. Used photoreceptor belt and new blades
2. Blade holder angle was set up to be between 31-33 deg with respect to the undeflected P/R
3. Blade working angle was set up to be 12-15 deg
4. Blade penetration/interference ~3-4 mm w.r.t. the undeflected P/R belt
5. Blade tip distance relative to downstream backer roll is ~14 mm.
6. Low area coverage images to be run to minimize toner lubrication to the blade edge Notes:

a) All the cleaning blades used were made with the Urethane Lakes blade material (82 A hardness)

b) Corner stiffener is made of a pre-plated cold rolled Steel

| CP/CS | NOMINAL |
|---|---|
| Blade Extension | 16 mm |
| Blade Thickness | 2.03 mm |
| Blade Length (no wings) | 423 mm |
| Blade Material | Acushnet Rubber Co. Formulation E-482 |
| Blade Material Hardness | 82 (shore A) |

Cleaning Blade Configurations

1. Baseline cleaning blade (Lakes urethane 82 A hardness) with no corner stiffeners
2. Baseline cleaning blade with a 40 mm long corner stiffener (4 mm width, 1 mm thick
3. Baseline cleaning blade with a 10 mm corner stiffener (4 mm width, 1 mm thick)

With each blade configuration, a 5 kp in 1 kp interval was run. The intent was to create start and stop conditions because startups are a vulnerable condition where the blade can potentially tuck.

Results: The cleaning blades with the 40 mm stiffener did not tuck. The baseline and 10 mm stiffener blade tucked during cycle up or within 300 prints. The test was repeated several times to validate the initial results and identical results were obtained. Similar results are obtainable when a stiffener is used across substantially the entire bottom length of the blade.

DETAILED DISCUSSION OF DRAWINGS AND PREFERRED EMBODIMENTS

Figure 1A:
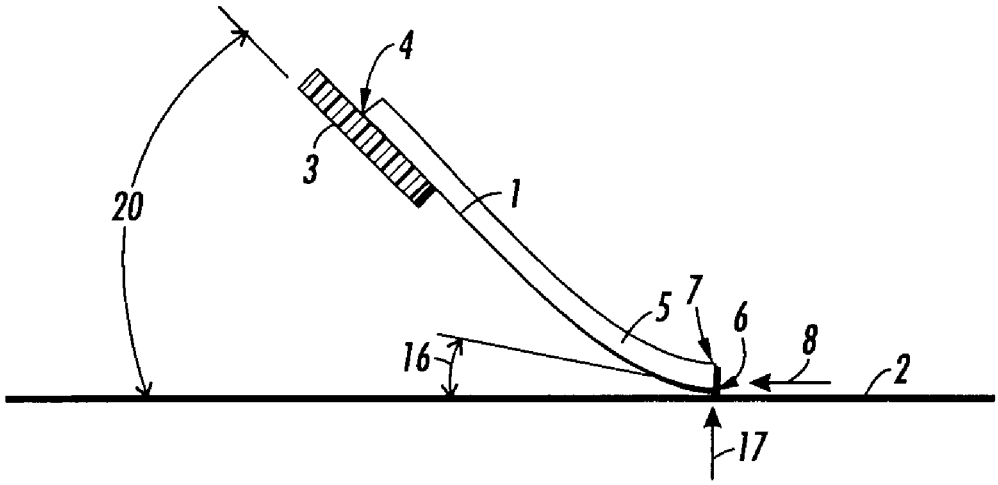
FIG. 1 is an illustration of a normal cleaning blade (in A) and a cleaning blade that has tucked in use (in B).
Figure 1B:
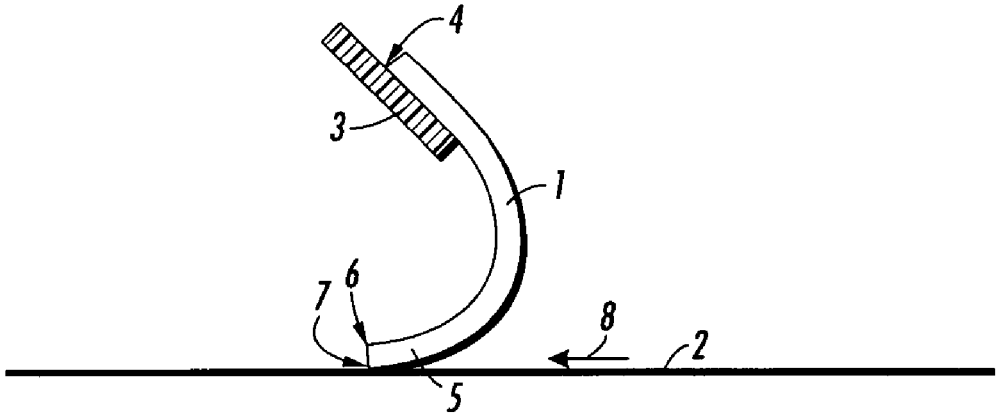

In FIG. 1A, a normal cleaning blade 1 as it normally contacts the photoreceptor (PC) surface 2 is shown in a side view. Often, in use, the cleaning blade 1, for many reasons including improper lubrication, becomes tucked as shown in FIG. 1B. Blade 1 optimization for cleaning, filming, abrasion and other performance parameters is highly constrained by the blade tuck. Once the blade 1 tucks, it can damage the PC surface and the blade. The cleaning blade 1 is connected to a blade holder 3 on one blade terminal edge (upper) 4 and the lower blade terminal edge 5 contacts and cleans the PC surface 2. The blade working edge 6 contacts the PC 2 in the cleaning operation while the blade edge 7 opposite the working edge is substantially free of PC contact. The PC travel direction is indicated by arrows 8. The working angle 16 is the angle between the blade 1 and the PC 2. The normal force 17 is the force applied by the blade 1 to the PC 2. The blade holder angle 20 is the angle between the blade holder 3 and the PC 2.

Figure 2:
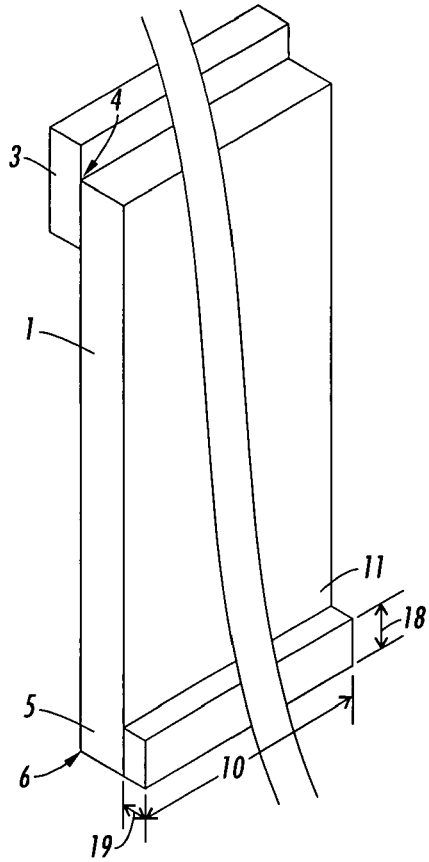
FIG. 2 illustrates an embodiment with the stiffener across the entire length of the cleaner blade.

In FIG. 2, a cleaning blade 1 is shown with a stiffener 9 positioned across the entire length 10 of blade 1. The width 18 and thickness 19 of the stiffener are shown. This embodiment shows stiffener 9 positioned on the blade side 11 opposite to the side of the working edge 6. The stiffener 9 prevents tucking and extends the life of the blade 1 and PC surface substantially. It prevents tucking and abrading of the PC 2. The stiffener 9 in all embodiments can be located on the blade side opposite to or on the same side as working edge 6.

Figure 3:
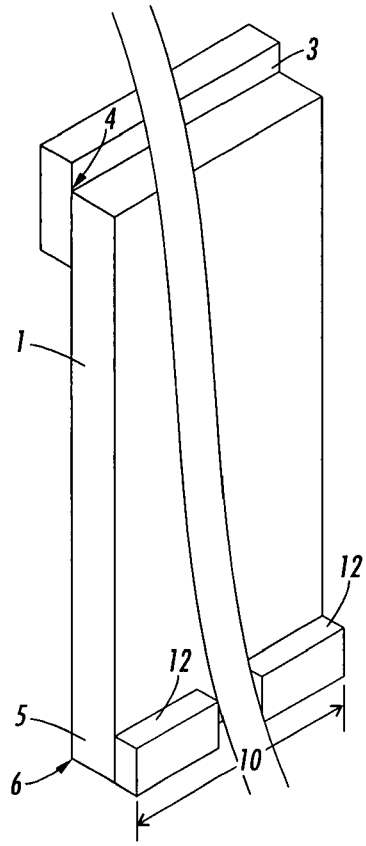
FIG. 3 illustrates an embodiment with corner stiffeners on the corners of the cleaning blade.

In FIG. 3, blade 1 is shown in another embodiment with corner stiffeners 12 positioned in corners of the lower portion 5 of blade 1 on the blade side opposite to the side of working edge 6. The stiffeners 9 and 12 can be made from any suitable material including wood, plastics or metals. The function of stiffeners 9 and 12 (and other stiffeners disclosed herein) is to increase the rigidity of the blade corners without significantly changing the working angle or normal force at the working edge 6. The blade 1 materials are widely known, usually an elastomer such as rubber, urethanes or other suitably known materials. When a presently-used blade 1 configuration is stiffened, it is preferred that the stiffeners 9 and 12 be positioned on the blade side opposite to the working edge 6.

Figure 4:
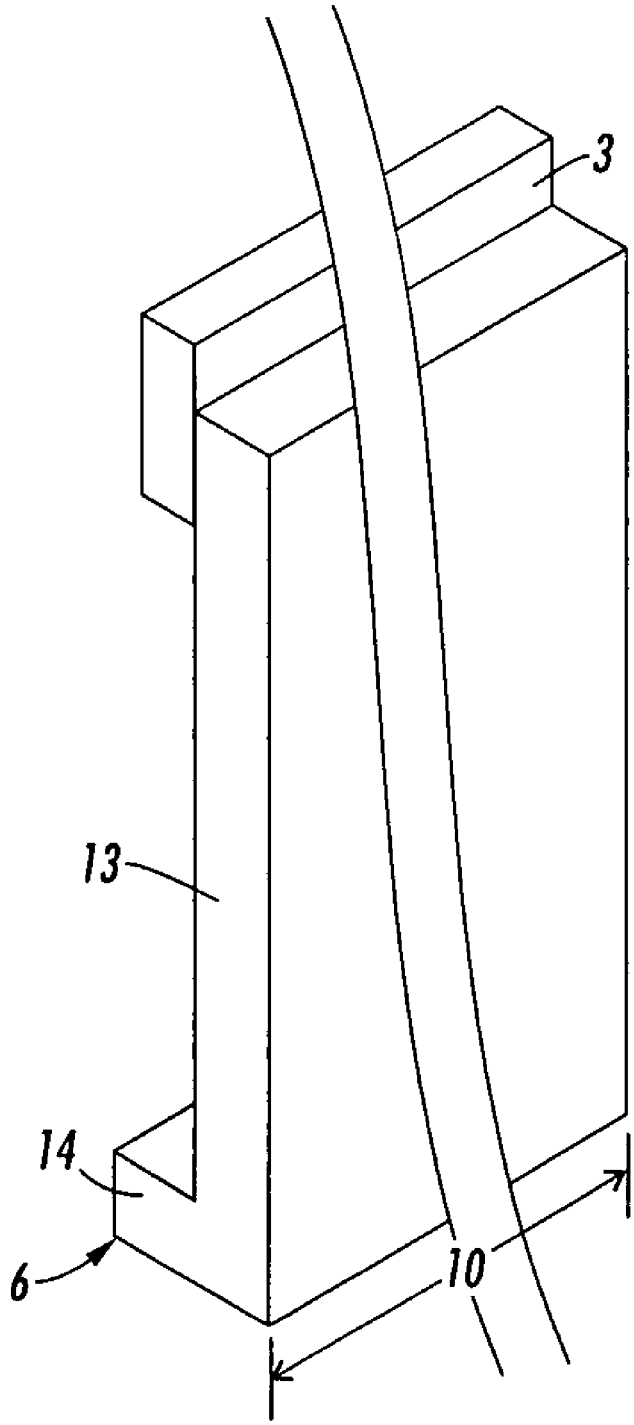
FIG. 4 illustrates an embodiment with the stiffener on the same side as the blade working edge (edge that contacts the photoreceptor).

In FIG. 4, a molded blade 13 is shown with the stiffener 14 positioned on the working edge 6 side of blade. Alternatively, stiffener 14 can be on the side opposite working edge 6 as shown in FIGS. 2 and 3. Since this blade 1 is made by a molding process, the stiffener 14 in this embodiment is of the same material as the blade 13.

Figure 5:
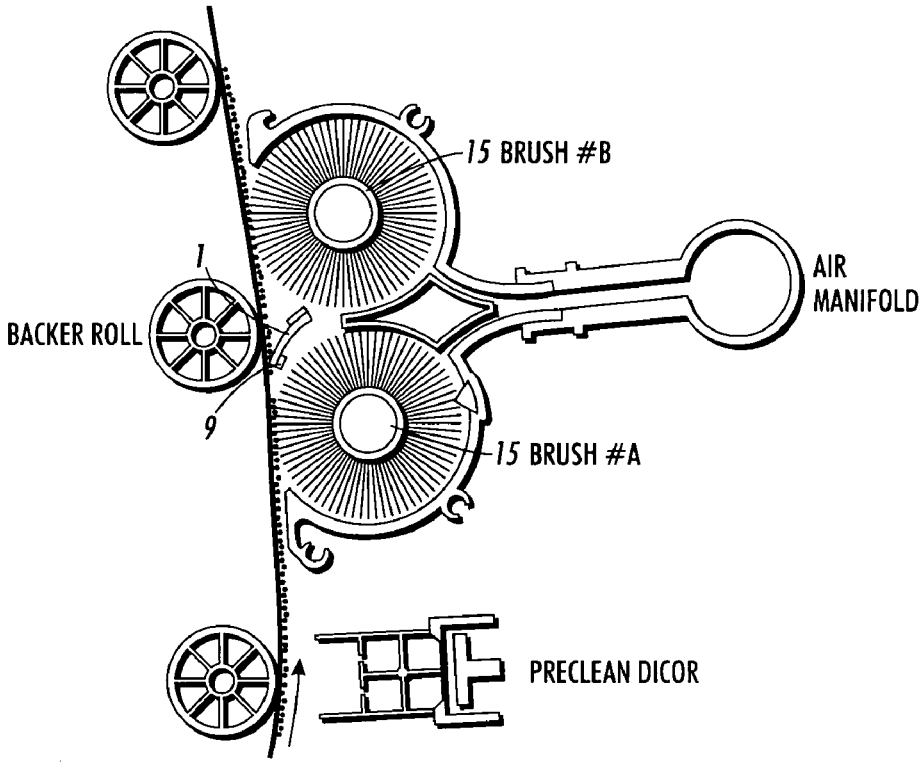
FIG. 5 illustrates a cleaning station or system where the stiffened cleaner blade of this invention can be used.

In FIG. 5, a Xerographic cleaning station or subsystem is shown where the stiffened cleaner blades of this invention can be used. The cleaner uses a urethane cleaning blade 1 between the two brushes 15. In this configuration, the cleaning blade 1 is the primary cleaning device and brush A is electrically biased to be in a non-cleaning or low-cleaning state. The main function of brush A is to transport toner from the cleaning blade edge 6 for removal by the air stream. Brush B is a back-up cleaning brush. Its primary function is to remove any toner that is left on the photoconductor 2 downstream of the cleaning blade 1. It is generally biased opposite to that of the toner charge polarity.

During the Cleaner critical parameter development phase, cleaning blade CPs such as the blade holder angle, working angle, blade penetration and blade tip distance relative to the backer roll, were optimized for cleaning, P/R abrasion and tucking. Blade tucks have always initiated near the ends of the blade 1. The tuck initiates at one end and works itself to the other end. The lower rigidity of the blade near the ends plays a large role in tuck initiation in this region. Today, there are general and loose design rules that are followed during the development of cleaning blades to prevent blade tucking. However, depending on the print engine architecture, the design rules may be very difficult to achieve. For example, extremely tight tolerances of parts may be required to hold the designed critical parameters such as blade holder angles or compensating for uncontrolled material behavior (e.g. blade relaxation). This invention provides an inexpensive and a very effective way to prevent tucking of blade 1. The cleaning blade 1 shown in FIG. 5 has a stiffener 9 positioned on the side opposite the side of the working edge 6.

Figure 6:
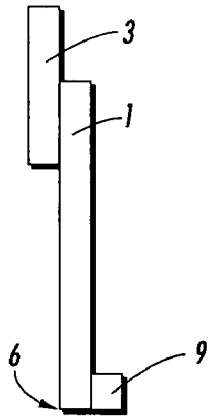
FIG. 6 is a side view showing a stiffener positioned on the blade side opposite to the working edge side.

In FIG. 6, a side view of a cleaning blade 1 is shown for further clarity. The stiffener 9 can be across the bottom edge length 10 of blade 1 or can be a stiffener 12 only in the corners of blade 1.

In summary, embodiments of this invention provide a cleaning blade for use in an electrophotographic marking system. The system comprises, in an operative relationship, a cleaning blade, a holder for the blade, a movable surface to be cleaned by the cleaning blade and a reinforcement or stiffener positioned on the blade. The blade comprises on its lower portion a working edge section. The working edge section is enabled to contact the movable surface. The blade comprises an upper portion that is connected to the holder and the stiffener which is located on the lower portion of the blade is enabled to minimize the blade tucking when the working edge contacts the surface to be cleaned during a cleaning operation. This stiffener, in one embodiment, is located on lower corner sections of the blade on a blade side opposite to the working edge side of the blade. In another embodiment, the stiffener is located on a lower section of the blade across substantially the entire length of the blade and is positioned on a blade side opposite to the working edge side of the blade. In a further embodiment, the stiffener is integral with and constructed of a material substantially the same as a material in the blade and the stiffener is positioned on the blade on either the side opposite to the working edge side or alternately on the same side as the working edge side.

The blade is a doctor blade wherein an extension of the blade is pointing in a direction opposite to the travel of the surface to be cleaned. The stiffener is constructed of the same or a material different from a material in the blade. The blade, in one embodiment, is generally located in the system where it is adapted to contact and clean a movable photoconductive surface. The cleaning blade has an upper edge and a lower edge, the upper edge is connected to a blade holder and the lower edge has a stiffener attached thereto. The lower edge has a working edge which is enabled to contact and clean the photoconductive surface. The stiffener is enabled to minimize tucking of the blade when the working edge contacts the photoconductive surface during the cleaning operation. The stiffener has dimensions suitable for preventing tucking of the blade during the cleaning operation and stiffener is enabled not to adversely modify the cleaning function of the cleaning blade.

It will be appreciated that variations of the above-disclosed and other features and functions, or alternatives thereof, may be desirably combined into many other different systems or applications. While for clarity, stiffeners of a rectangular cross-section are defined in this disclosure, drawings and claims, other suitable configurations other than rectangular are included within the scope of this invention. Also that various presently unforeseen or unanticipated alternatives, modifications, variations or improvements therein may be subsequently made by those skilled in the art which are also intended to be encompassed by the following claims.

What is claimed is:

1. A cleaning blade adapted for use in cleaning a photoconductive surface in an electrophotographic marking system, said cleaning blade having an upper portion and a lower portion, said upper portion connected to a blade holder, said lower portion having a stiffener attached thereto, said lower portion comprising a working edge which is configured to contact and clean said photoconductive surface, said stiffener configured to minimize tucking of said blade when said working edge contacts said photoconductive surface during a cleaning operation, said stiffener having dimensions suitable for preventing tucking of said blade during said cleaning operation, said stiffener configured not to adversely modify a cleaning function of said cleaning blade, and wherein said stiffener is located on a blade side opposite to a blade side holding said working edge.

2. The blade of claim 1 wherein said stiffener is located on lower corner sections of said blade on a blade side opposite to the working edge side of said blade.

3. The blade of claim 1 wherein said stiffener is located on a lower section of said blade across substantially the entire length of said blade, and positioned on a blade side opposite to the working edge side of said blade.

4. The blade of claim 1 wherein said stiffener is constructed of a material substantially the same as a material in said blade and said stiffener is positioned on said blade on the side opposite to the working edge side.

5. The blade of claim 1 wherein said stiffener is constructed of a substantially rigid material different from a material in said blade.

* * * * *